US008544393B2

(12) United States Patent
Branch et al.

(10) Patent No.: US 8,544,393 B2
(45) **Date of Patent: *Oct. 1, 2013**

(54) HANDLE FOR A PORTABLE TABLE

(75) Inventors: Paul Branch, Layton, UT (US); Ed VanNimwegen, North Ogden, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/458,836

(22) Filed: Apr. 27, 2012

(65) Prior Publication Data

US 2012/0210915 A1 Aug. 23, 2012

Related U.S. Application Data

(63) Continuation of application No. 13/309,480, filed on Dec. 1, 2011, now Pat. No. 8,166,894, which is a continuation of application No. 12/033,647, filed on Feb. 19, 2008, now Pat. No. 8,091,490.

(60) Provisional application No. 60/891,198, filed on Feb. 22, 2007, provisional application No. 60/891,193, filed on Feb. 22, 2007.

(51) Int. Cl.
*A47B 3/083* (2006.01)

(52) U.S. Cl.
USPC ..... 108/169; 108/129; 108/125

(58) Field of Classification Search
USPC ..... 108/166–169, 174, 129, 125, 14; 190/115; 220/7, 770, 762, 761; 16/425, 16/422, 110.1
See application file for complete search history.

(56) References Cited

U.S. PATENT DOCUMENTS

| | | | | |
|---|---|---|---|---|
| 2,693,258 | A * | 11/1954 | Fleisch | 190/11 |
| 2,829,705 | A * | 4/1958 | Godshalk et al. | 297/2 |
| 4,883,314 | A * | 11/1989 | Sakong | 297/158.4 |
| 5,009,170 | A * | 4/1991 | Spehar | 108/36 |
| 5,961,194 | A * | 10/1999 | Shaw | 312/352 |
| 6,000,345 | A * | 12/1999 | Gillotti | 108/36 |
| 6,058,853 | A * | 5/2000 | Pinch | 108/129 |
| 6,334,400 | B1 * | 1/2002 | Nien | 108/115 |
| 6,705,234 | B1 * | 3/2004 | Miller et al. | 108/36 |
| 7,093,893 | B1 * | 8/2006 | Bunde | 297/17 |
| 7,278,515 | B2 * | 10/2007 | Moser et al. | 182/152 |
| 7,823,517 | B2 * | 11/2010 | Roleder | 108/27 |
| 8,091,490 | B2 * | 1/2012 | Branch et al. | 108/169 |
| 8,116,894 | B2 * | 2/2012 | Miyata et al. | 700/121 |
| 8,156,875 | B2 * | 4/2012 | Neunzert et al. | 108/132 |
| 2002/0092445 | A1 * | 7/2002 | Glover et al. | 108/129 |
| 2005/0274302 | A1 * | 12/2005 | Jin et al. | 108/126 |

* cited by examiner

*Primary Examiner* — Darnell Jayne
*Assistant Examiner* — Daniel Rohrhoff
(74) *Attorney, Agent, or Firm* — Maschoff Brennan

(57) ABSTRACT

A table may include a handle to enhance portability. For example, if the table is a fold-in-half table, a first portion of a handle may be connected to a first portion of the table top and a second portion of the handle may be connected to a second portion of the table top. The first and second sections of the handle may be collectively grasped, which may help prevent the table top from unintentionally unfolding. The table top may also include receiving portions sized configured to receive portions of the handle. This may allow, for example, at least a substantial portion of the handle to be disposed in the receiving portions when the handle is in a refracted position and at least a substantial portion of the handle to be disposed outside the receiving portions when the handle is in an extended position.

19 Claims, 6 Drawing Sheets

HANDLE FOR A PORTABLE TABLE

CROSS-REFERENCE TO RELATED APPLICATIONS

The present application is a continuation of U.S. patent application Ser. No. 13/309,480, filed on Dec. 1, 2011, entitled HANDLE FOR A PORTABLE TABLE, now U.S. Pat. No. 8,166,894; which is a continuation of U.S. patent application Ser. No. 12/033,647, filed on Feb. 19, 2008, entitled HANDLE FOR A PORTABLE TABLE, now U.S. Pat. No. 8,091,490; which claims priority to and the benefit of U.S. provisional patent application Ser. No. 60/891,198, filed Feb. 22, 2007, entitled HANDLE FOR A PORTABLE TABLE; and U.S. provisional patent application Ser. No. 60/891,193, filed Feb. 22, 2007, entitled HANDLE FOR A PORTABLE TABLE.

These applications and patents are each incorporated by reference in their entireties.

BACKGROUND OF THE INVENTION

1. The Field of the Invention

The present invention generally relates to furniture and, in particular, to tables.

2. Description of Related Art

Many different types of tables are well known and used for a variety of different purposes. For example, conventional tables may include legs that are pivotally attached to a table top and the legs may be movable between a use position in which the legs extend outwardly from the table top and a storage position in which the legs are folded against the table top. Conventional tables with relatively large table tops and folding legs are often referred to as "banquet tables" and these tables are frequently used in assembly halls, banquet halls, convention centers, hotels, schools, churches and other locations where large groups of people meet. Because these conventional tables are generally easy to move and relatively portable, these types of tables can often be positioned in an assortment of different configurations and used in a variety of settings. When the tables are no longer needed, the table legs can be moved into the storage position and the tables may be moved or stored.

Conventional banquet tables with collapsible legs may allow the table to be more conveniently stored. The table top for many conventional banquet tables with collapsible legs, however, retains its size and shape. For example, many known banquet tables have a length between six to ten feet and a width between three to four feet. As a result, the storage of a conventional banquet table, even with the legs in the collapsed position, may require a relatively large storage area. This relatively large storage area required to store a conventional banquet table may be compounded if multiple tables have to be stored. For example, larger facilities, such as hotels, schools and churches, may require a significant amount of storage space because a considerable number of these tables may have to be stored. In addition, smaller facilities, such as restaurants, offices and homes, may use one or more conventional banquet tables. These smaller facilities may use the tables less frequently, such as during special occasions. Conventional banquet tables, even when the legs are folded, may be too bulky and obstructive to be conveniently used and stored at such smaller facilities. As a result, it is often necessary for both larger and smaller facilities to rent and/or borrow one or more banquet tables when needed.

Disadvantageously, this process of renting and/or borrowing banquet tables can be inconvenient, time consuming and costly.

In addition, conventional banquet tables are often very difficult to move or transport from one location to another. For example, because of the length of many conventional banquet tables, the tables are often difficult to move by a single person. The extended length of the banquet tables may also preclude the tables from being transported in the trunk or back seat of a typical passenger car. Accordingly, the banquet tables may have to be transported by a truck or trailer, which may be difficult to obtain, expensive and require a significant amount of time.

It is also known to construct tables that are capable of being folded-in-half In particular, conventional fold-in-half tables typically include a table top with two sections that are pivotally connected by a hinge. The two sections of the table top may be moved between an unfolded position or use position in which the sections of the table top are generally aligned in the same plane and a folded position in which the two sections are positioned generally adjacent to each other for storage.

Unfortunately, when conventional fold-in-half tables are in the folded or storage position, it may be difficult to lift and move the table because it may be hard to grasp the table. In addition to many conventional fold-in-half tables being difficult to grasp and move in the folded position, the table tops may unintentionally unfold while being moved.

BRIEF SUMMARY OF EMBODIMENTS OF THE INVENTION

A need therefore exists for a table that reduces or eliminates the above-described and other disadvantages and problems.

One aspect is a table that may include a table top and one or more legs or support pedestals that may be used to support the table top in a use or support position. The legs or support pedestals are preferably movable between an extended or use position and a collapsed or storage position relative to the table top. Advantageously, when the legs or support pedestals are in the use position, the table may be used to support a wide variety of objects and the table may be used for a variety of different purposes.

Another aspect is a table that may include a table top which is capable of being moved between a folded position and an unfolded position. Preferably, the table top includes two sections and the two sections are generally aligned in the same plane when the table top is in the unfolded position and the two sections are generally positioned adjacent and parallel to each other when the table top is in the folded position. The table may also include legs that are movable between a use position and a collapsed position. Advantageously, if the table includes both a foldable table top and foldable legs that can be selectively moved between use and collapsed positions, then the table may be stored in a relatively compact area. This may allow, for example, a single person to easily move and transport the table. In addition, this may allow the table to be positioned in a relatively small area, such as the backseat or trunk of an automobile. Further, this may allow one or more tables to be shipped and/or stored in relatively small areas.

Still another aspect is a table that may include a table top which is constructed from plastic. Preferably the table top is constructed from blow-molded plastic, but it may be manufactured from other suitable materials and processes. Advantageously, a blow-molded plastic table top may be lightweight, easily constructed and it may allow the table top to be formed into various desired configurations, shapes, sizes and designs. This may also allow a table top to be constructed that is generally weather resistant and temperature insensitive, which may allow the table to be used in a wide variety of locations and environments. In addition, this may allow a table top that is durable, long-lasting and corrosion resistant to be constructed. Further, because a table top constructed from blow-molded plastic may be relatively strong, the table may be used to support a relatively large amount of weight. Significantly, a table top constructed from blow-molded plastic may also form a structural member of the table, but the table top may be supported by other structures, such as a frame.

Advantageously, a table top constructed from blow-molded plastic may be relatively strong because it may include opposing walls or surfaces that are separated by a distance. In particular, the opposing walls or surface may be separated by a relatively constant distance. The opposing walls may help create a high-strength, rigid table top. In addition, because the interior portion of the table top may be generally hollow, that may create a lightweight table top. Thus, the blow-molded table top may be both lightweight and strong.

Yet another aspect is a handle that may be sized and configured to facilitate carrying or moving a table. Advantageously, the handle may be used in connection with various suitable types of tables, such as a foldable table. For example, the foldable table may include a table top with two sections that are movable between folded and unfolded positions, and the handle may be accessible when the table top is in the folded position. In particular, at least a portion of the handle may be exposed when the table top is in the folded position, which may allow a person to easily grasp the handle and carry the folded table.

A further aspect is a handle that may be sized and configured to be moved between an extended position and a retracted position relative to the table top and/or table. For example, the handle may be sized and configured to be moved between the extended and refracted positions when the table top is in the folded position. The handle may also be sized and configured to be moved between the extended and retracted positions when the table top is in the unfolded position. It will be appreciated, however, that the handle need not be movable.

A still further aspect is a handle that may be sized and configured to be moved between an extended position in which the handle extends beyond an outer edge or perimeter of a table top and a retracted position in which the handle is generally flush with or disposed within the outer edge or perimeter of the table top. Desirably, the handle may be more easily grasped when it extends beyond the outer edge or perimeter of the table top. In addition, the table may be more compactly stored and/or shipped when the handle is in the refracted position. Moreover, the handle may not interfere with the ordinary use of the table when the handle is in the retracted position.

Another aspect is a table top that may include one or more receiving portions that are sized and configured to receive at least a portion of a handle. The receiving portions may be integrally formed with the table top as part of a unitary structure during, for example, a blow-molding or other suitable manufacturing process. Advantageously, all or a portion of the handle may be stored within the receiving portions. For example, the handle may be at least substantially disposed within the receiving portions when the handle is in a retracted position. On the other hand, the handle may be at least substantially disposed outside the receiving portions when the handle is in an extended position.

Still another aspect is a table top that may include a first table top section with a receiving portion and a second table top section with a receiving portion. The receiving portion of the first table top section may be sized and configured to receive a first portion of the handle, and the receiving portion of the second table top section may be sized and configured to receive a second portion of the handle. The first and second portions of the handle may be at least substantially disposed in the respective receiving portions of the first and second table top sections when the handle is in a refracted position. The first and second portions of the handle may be at least substantially disposed outside of the receiving portions of the first and second table top sections when the handle is in an extended position.

Yet another aspect is a table that may include a handle with a first section and a second section. The table may also include a table top, a frame connected to the table top and the table top may be foldable. In particular, the frame may include a first side rail connected to a first portion of the table top and a second side rail connected to a second portion of the table top. When the table top and/or the side rail are in the unfolded position, the first and second handle sections may be spaced at least a substantial distance apart and/or the first and second handle sections may be generally aligned in the same plane. When the table top and/or the side rail are in a folded position, the first and second handle sections may be generally parallel to each other and may contact, abut and/or engage each other, which may allow the handle sections to be collectively grasped. Collectively grasping the handle sections may advantageously help prevent the table top and/or the side rail from unintentionally unfolding while carrying the table.

A further aspect is a table that may include a table top with a first receiving portion and a second a receiving portion. The table may also include a handle and a first portion of the handle may be generally fixedly disposed in the first receiving portion of the table top and a second portion of the handle may be generally fixedly disposed in the second receiving portion of the table top. Desirably, the receiving portions may be sized and configured to allow the first and second sections of the handle to be easily grasped. If desired, the handle sections may be generally flush with or within the outer edge or perimeter of the table top.

A still further aspect is a table that may include a handle that is at least partially constructed from materials such as plastic. The plastic portions of the handle are preferably constructed from gas-assisted injection molding, but the plastic portions of the handle may be constructed using gas-assisted injection molding, injection molding, other molding processes and/or other manufacturing processes. Significantly, all or a portion of the handle may be constructed from plastic and the handle may be constructed from multiple pieces or it may be formed as part of a unitary, one-piece structure.

Another aspect is a table that may include a table top with one or more sections that are interconnected. For example, a frame may be attached to the sections of the table top and the frame may be sized and configured to allow the table top to be moved between the folded and unfolded positions. In particular, the frame may include one or more side rails that are connected to the sections of the table top and one or more hinge assemblies may be connected to the side rails. The hinge assemblies may enable the table top to move between the folded and unfolded positions. Preferably, the hinge assemblies are mounted directly to the frame and the hinge assemblies need not be directly connected to the table top. Because mechanical fasteners are not required to directly attach the hinge assemblies to the table top, fewer parts may be required to assemble the table and holes do not have to be formed in the table top, which may allow the table to be quickly and easily manufactured and assembled. Because the hinge assemblies do not have to be separately mounted directly to the table top by screws or other fasteners, this may allow retailers or consumers to assemble the table if desired. The hinge assemblies, however, could be mounted to the table top, if desired.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

The present invention is generally directed towards tables. The principles of the present invention, however, are not limited to tables. It will be understood that, in light of the present disclosure, the table disclosed herein can be successfully used in connection with other types of furniture or devices.

Additionally, to assist in the description of the table, words such as top, bottom, front, rear, right and left may be used to describe the accompanying figures, which are not necessarily drawn to scale. It will be appreciated, however, that the table can be located in a variety of desired positions and/or orientations. A detailed description of the table now follows.

Figure 1:
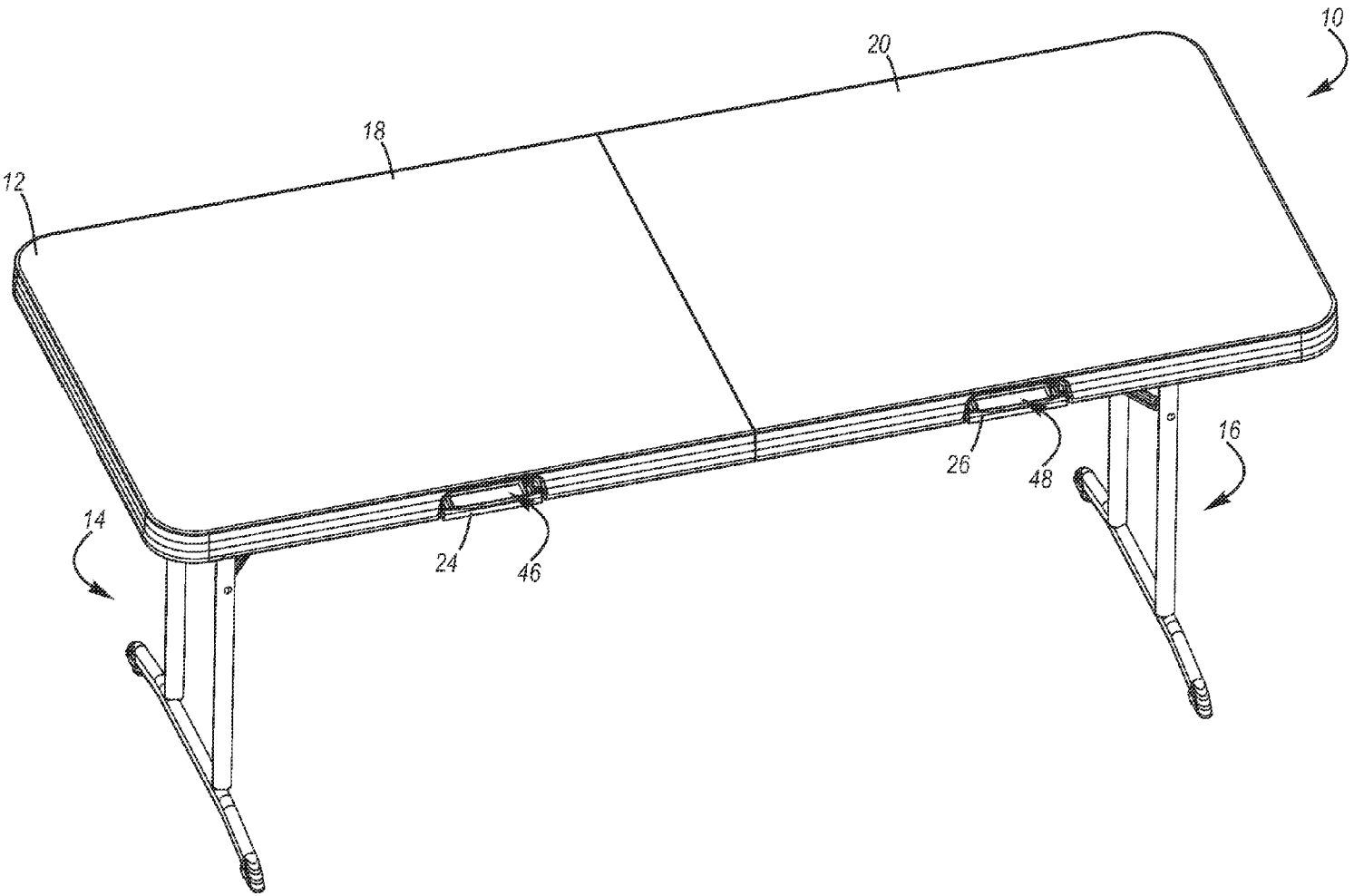
FIG. 1 is a perspective view of an exemplary table, illustrating the table as a fold-in-half table with the table in an unfolded or use position.

As shown in FIG. 1, a table 10 may include a table top 12 and one or more legs or support pedestals 14, 16 that may be used to support the table top in a use or support position. The legs or support pedestals 14, 16 are preferably movable between an extended or use position and a collapsed or storage position relative to the table top 12. Advantageously, when the legs or support pedestals 14, 16 are in the use position, the table 10 may be used to support a wide variety of objects and the table may be used for a variety of different purposes. It will be appreciated that the legs or support pedestals 14, 16 may have any of a wide variety of sizes, shapes and/or configurations.

The table 10 and/or the table top 12 may be movable between a folded position and an unfolded position. For example, the table top 12 preferably includes two sections 18, 20 that may be generally aligned in the same plane when the table top is in the unfolded position as shown in FIG. 1 and may be generally positioned adjacent and parallel to each other when the table top is in the folded position as shown in FIG. 2.

Significantly, because the table top 12 may be movable between a folded position and an unfolded position, the table 10 may be stored in a relatively compact area. This may allow, for example, a single person to easily move and transport the table 10. In addition, this may allow the table 10 to be positioned in a relatively small area, such as the backseat or trunk of an automobile. Further, this may allow one or more tables 10 to be shipped and/or stored in relatively small areas.

Figure 3:
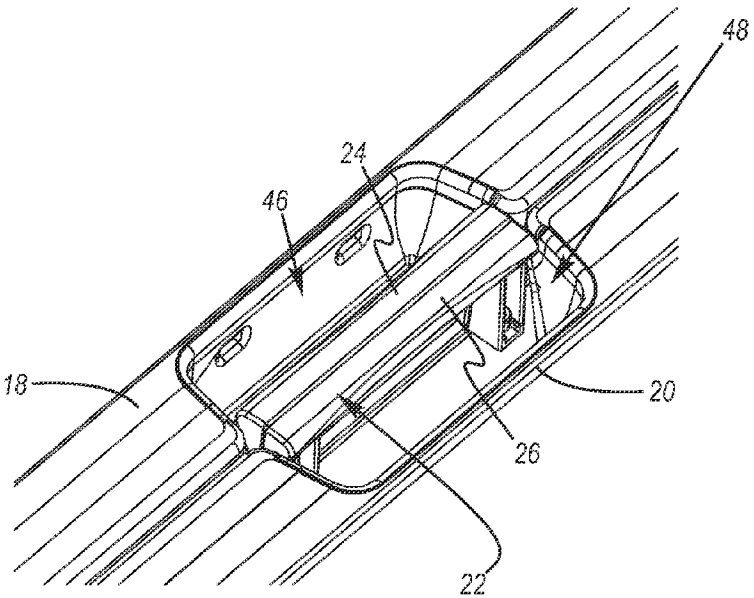
FIG. 3 is an enlarged perspective view of a portion of the table shown in FIG. 2.
Figure 2:
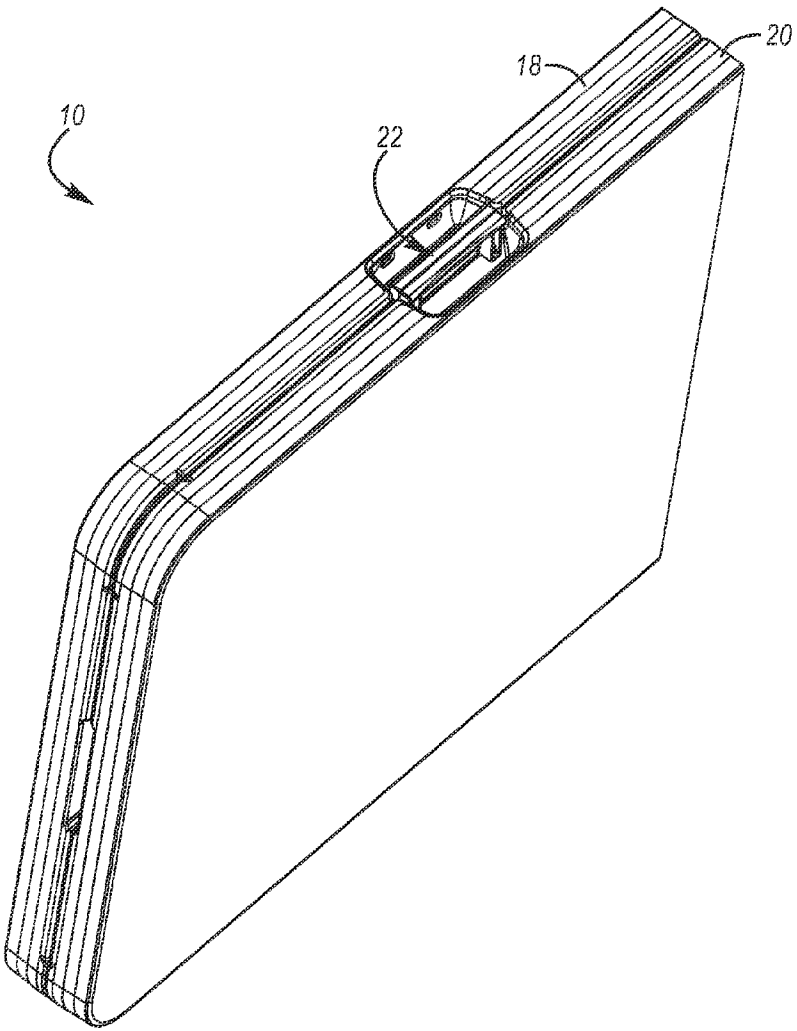
FIG. 2 is a perspective view of the table shown in FIG. 1, illustrating the table in a folded position.

As shown in FIGS. 2-3, the table 10 may include a handle 22 sized and configured to facilitate carrying or moving the table. Desirably, the handle 22 may be accessible when the table top 12 is in the folded position. For example, at least a portion of the handle 22 may be exposed when the table top 12 is in the folded position, which may allow a person to easily grasp the handle and carry the folded table 10. Thus, the handle 22 may make the table 10 more portable.

As shown in FIGS. 1-3, the handle 22 may include a first handle section 24 and a second handle section 26. The handle sections 24, 26 may be connected to the table top sections 18, 20, respectively. Significantly, collectively grasping the handle sections 24, 26 may advantageously help prevent the folded table top 12 from unintentionally unfolding while the table 10 is carried.

Figure 4:
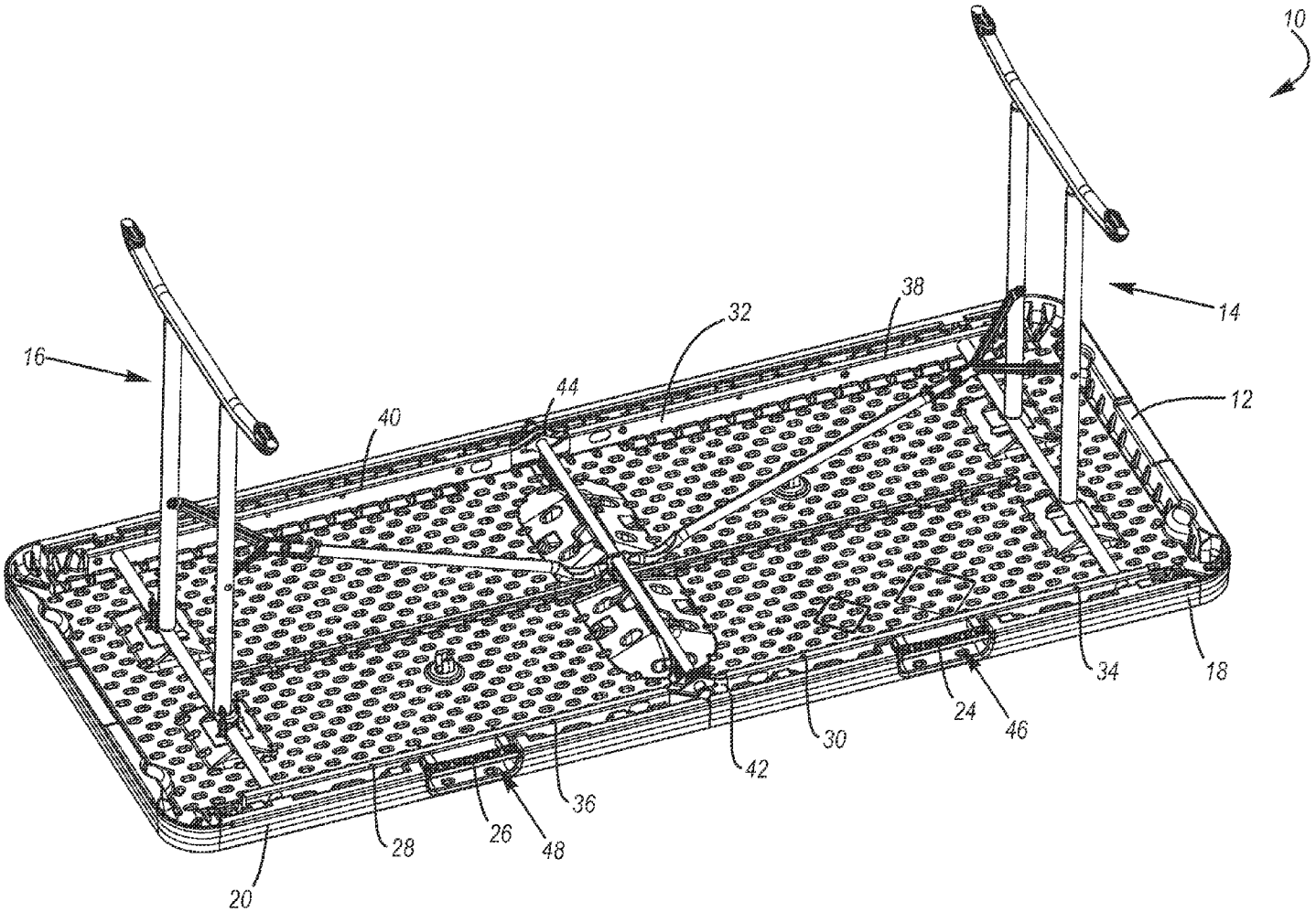
FIG. 4 is a lower perspective view of the table shown in FIG. 1.

In further detail, as shown in FIG. 4, the table 10 may include a table frame 28, which may be connected to the table top 12 and which may be sized and configured to help the table top move between the folded and unfolded positions. The legs or support pedestals 14, 16 may also be pivotally or otherwise movably connected to the frame 28 to help them move between the extended or use position and the collapsed or storage position relative to the table top 12.

Figure 5:
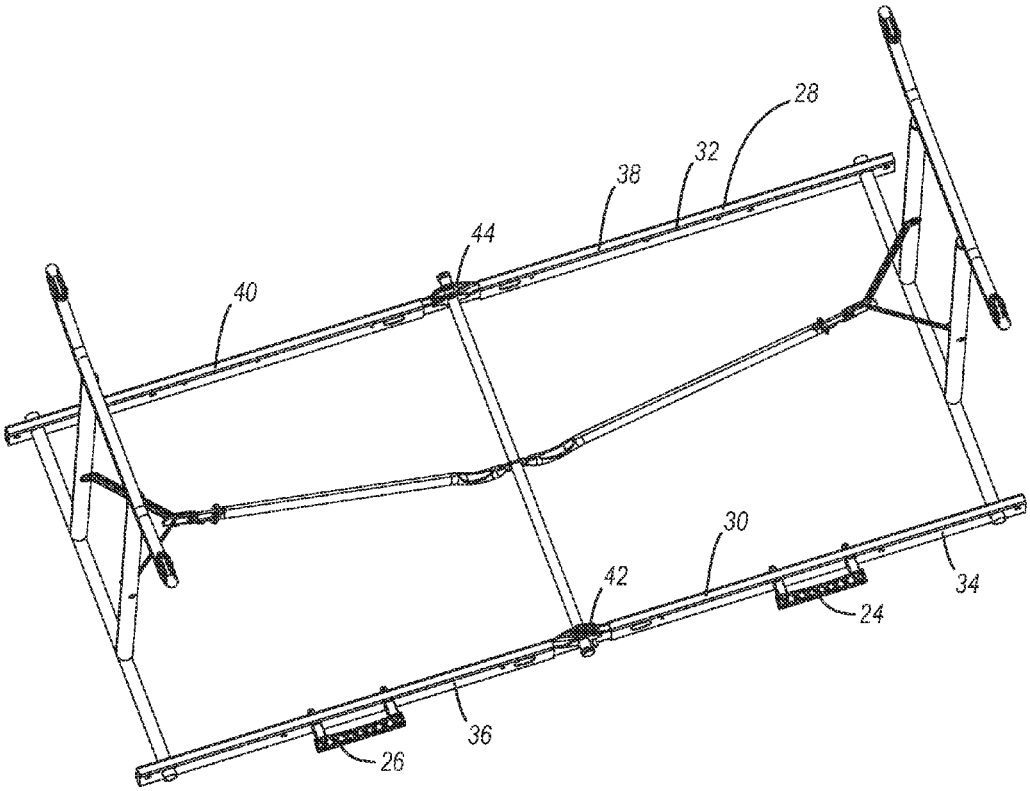
FIG. 5 is a lower perspective view of a portion of the table shown in FIG. 1.

The table frame 28 preferably includes at least one side rail, such as side rails 30, 32, which may include a plurality of side rail sections. For example, as shown in FIGS. 4-5, the side rail 30 may include side rail sections 34, 36 that may be movable between a folded and unfolded position, and the side rail 32 may include side rail sections 38, 40 that may be movable between a folded and unfolded position. The handle sections 24, 26 may be connected to the side rail sections 34, 36, respectively, and the side rail sections 34, 36 may be connected to the table top sections 18, 20, respectively, to connect the handle sections to the table top 12. The side rail sections 38, 40 may also be connected to the table top sections 18, 20, respectively. It will be appreciated that the handle sections 24, 26 may be connected to the table top sections 18, 20, the side rail sections 34, 36 and/or any other portion of the frame 28 or table 10.

When the table 10, the table top 12 and/or the side rail 30 are in a folded position as shown in FIGS. 2-3, the handle sections 24, 26 may be generally parallel to each other and may contact, abut and/or engage each other, which may allow the handle sections to be collectively grasped. Collectively grasping the handle sections 24, 26 may advantageously help prevent the table top 12 and/or the side rail 30 from unintentionally unfolding while the table 10 is carried.

When the table 10, the table top 12 and/or the side rail 30 are in an unfolded position, the handle sections 24, 26 may be spaced at least a substantial distance apart from each other and/or generally aligned in the same plane as shown in FIG. 4. For example, when the table 10, the table top 12 and/or the side rail 30 are in the unfolded position, the handle sections 24, 26 may be spaced from about one or two feet to about four or five feet apart. Significantly, this may allow the handle sections 24, 26 to be individually grasped when the unfolded table 10 is carried by a single person or by multiple persons. Of course, the handle sections 24, 26 may be spaced apart at greater or lesser distances when the table 10, the table top 12 and/or the side rail 30 are in the unfolded position. It will also be appreciated that the handle 22 need not comprise a plurality of handle sections 24, 26 may comprise a unitary, one-piece handle that may be connected to any suitable portion of the table 10.

As shown in FIGS. 2-3, one or more hinge assemblies 42, 44 may be connected to the side rails 30, 32 to help the table top 12 and the side rails to move between the folded and unfolded positions. The hinge assemblies 42, 44 may be mounted directly to the frame 28 and need not be directly connected to the table top 12. Because mechanical fasteners are not required to directly attach the hinge assemblies 42, 44 to the table top 12, fewer parts may be required to assemble the table 10 and holes do not have to be formed in the table top, which may allow the table to be quickly and easily manufactured and assembled. Because the hinge assemblies 42, 44 do not have to be separately mounted directly to the table top 12 by screws or other fasteners, this may allow retailers or consumers to assemble the table 10 if desired. It will be appreciated, however, that the hinge assemblies 42, 44 may directly connected to the table top 12 and/or any other suitable portion of the table 10 using one or more fasteners and/or any other suitable means.

As shown in FIG. 3, the table top 12 may include one or more receiving portions sized and configured to receive at least a portion of the handle 22. For example, the table top section 18 may include a receiving portion 46 that may receive a first portion of the handle 22 (such as at least a portion of the handle section 24) and the table top section 20 may include a receiving portion 48 that may receive a second portion of the handle (such as at least a portion of the handle section 26).

If the table top 12 is constructed from blow-molded plastic, the receiving portions 46, 48 may be integrally formed with the table top during the blow-molding process. For instance, the receiving portions 46, 48 may be integrally formed with the table top sections 18, 20 during the blow-molding process. It will be appreciated, however, that the table top sections 18, 20 and the receiving portions 46, 48 may be constructed from other materials and using other processes. It will also be appreciated that the receiving portions 46, 48 need not be integrally formed with the table top 12.

Figure 6:
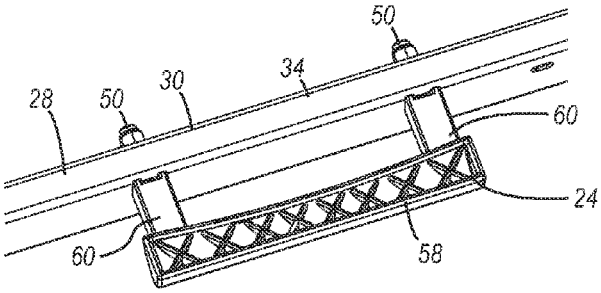
FIG. 6 is an enlarged perspective view of a portion of the table shown in FIG. 5.
Figure 7:
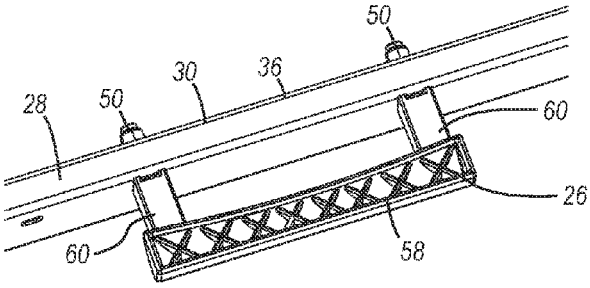
FIG. 7 is an enlarged perspective view of a portion of the table shown in FIG. 5.

In some embodiments, the handle sections 24, 26 may be generally fixedly disposed in the receiving portions 46, 48 of the table top sections 18, 20. In further detail, the handle sections 24, 26 may be generally fixedly connected to the side rail sections 34, 36 using one or more fasteners, adhesives, welds and/or any other suitable means. For example, as shown in FIGS. 6 and 7, the handle sections 24, 26 may be generally fixedly connected to the side rail sections 34, 36 using one or more fasteners 50, such as screws or other fasteners. The fasteners 50 may extend through openings in spaced-apart and/or opposing sides, walls or portions the side rail sections 34, 36 to engage, bite into and/or be connected to the handle sections 24, 26. In particular, as shown in FIG. 8, the side rail sections 34, 36 may comprise tubes, and the fasteners 50 may help provide greater stability for the handle sections 24, 26 by extending through openings 52 in spaced-apart and/or opposing sides, walls or portions 54, 56 of the tubes.

As shown in FIG. 3, the receiving portions 46, 48 may be sized and configured to allow the generally fixed handle sections 24, 26 to be easily grasped. In addition, the handle sections 24, 26 are preferably generally flush with or within the outer edge or perimeter of the table top sections 18, 20.

The handle 22 and/or the handle sections 24, 26, however, need not be generally fixedly connected to the side rail sections 34, 36 or generally fixedly disposed in the receiving portions 46, 48. For example, the handle 22 may be movable between a retracted position in which a first portion of the handle and a second portion of the handle are disposed, respectively, in the receiving portions 46, 48 and an extended position in which the first and second portions of the handle are disposed outside of the receiving portions. The handle 22 may extend beyond an outer edge or perimeter of the table top 12 when in the extended position and may be generally flush with or within the outer edge or perimeter of the table top when in the retracted position. Desirably, the handle 22 may be more easily grasped when it extends beyond the table top's outer edge. In addition, the table 10 may be more compactly stored and/or shipped when the handle 22 is generally flush with or within the table top's outer edge. Moreover, the handle 22 may not interfere with the ordinary use of the table when the handle is in the retracted position. If desired, the handle 22 may be movable between the retracted and extended positions when the table 10 and/or the table top 12 are in the folded position shown in FIG. 2. The handle 22 may also be movable between the retracted and extended positions while the table 10 and/or the table top 12 are in the unfolded position shown in FIG. 1.

Figure 8:
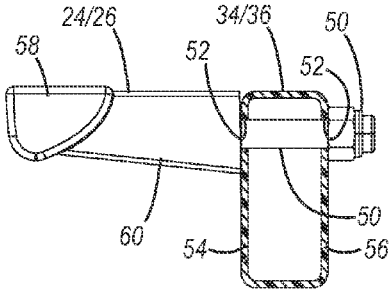
FIG. 8 is a partial cross-sectional side view a portion of the table shown in FIG. 5.

As shown in FIGS. 6-8, the handle sections 24, 26 may include a grip 58 that is sized and configured to be grasped by a person carrying the table and one or more connecting members 60 sized and configured to connect the grip to the side rail 30, the frame 28, the table top 12 and/or other portions of the table 10. As shown in FIG. 8, the fasteners 50 may extend through the openings 52 to engage, bite into and/or be connected to the connecting members 60 of the handle sections 24, 26. The fasteners, however, need not engage, bite into and/or be connected to the connecting members 60 and may engage, bite into and/or be connected to other portions of the handle sections 24, 26.

The grip 58 and/or the connecting members 60 may be constructed from a generally rigid material, such as injection-molded plastic. If desired, the grip 58 and the connecting members 60 may be integrally formed as part of a unitary, one-piece structure, for example, during an injection-molding process. It will be appreciated, however, that grip 58 and the connecting members 60 may be constructed using other suitable molding or manufacturing processes and may be constructed from plastic, metal, wood and/or other materials having other suitable characteristics. It will be also appreciated that the grip 58 and the connecting members 60 may comprise discretely formed components, which may be constructed from different materials and/or different manufacturing processes from each other and then later assembled. It will be further appreciated that the handle sections 24, 26 may include a variety of other components having other suitable sizes, shapes and/or configurations.

Figure 9:
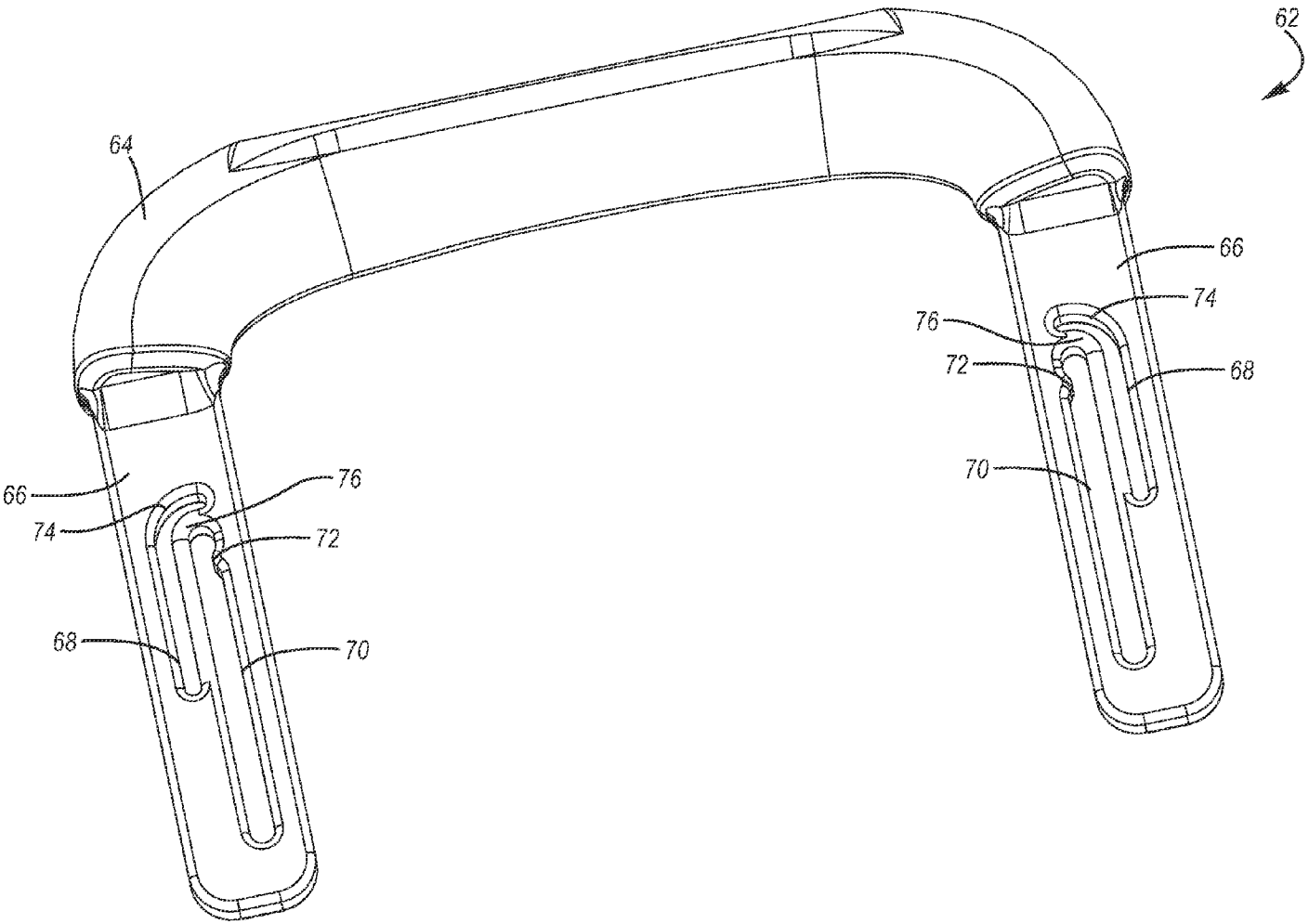
FIG. 9 is an enlarged perspective view of an exemplary handle.

With reference to FIG. 9, a handle 62 may be used in connection with the table 10 shown in FIG. 1. In further detail, the handle 62 may be sized and configured to be moved between an extended position and a retracted position. The handle 62 may be movable between the retracted and extended positions when the table 10 and/or the table top 12 are in the folded position shown in FIG. 2. The handle may also be movable between the refracted and extended positions while the table 10 and/or the table top 12 are in the unfolded position shown in FIG. 1.

The handle 62 may extend beyond an outer edge or perimeter of the table top 12 when in the extended position and may be generally flush with or within the outer edge or perimeter of the table top when in the retracted position. In addition, a first portion of the handle 62 and a second portion of the handle may be disposed, respectively, in the receiving portions 46, 48 when in the retracted position and may be disposed outside the receiving portions when in the extended position.

The handle 62 may include a grip 64 that is sized and configured to be grasped by a person carrying the table and one or more connecting members 66 sized and configured to connect the grip to the table 10. The connecting members 66 preferably include one or more elongated slots 68, 70 sized and configured to help movably connect the handle 62 to the table 10. In particular, one or more fasteners, pins or projections (which may be formed in or connected to the side rail 30, the frame 28, the table top 12 and/or other portions of the table 10) may slidably couple the slots 68, 70 and thus facilitate the handle's movement between the extended and retracted positions. For example, one or more fasteners may be inserted through the slots 68, 70 and one or more openings in the side rail 30 of the frame 28 to movably connect the handle 62 to the frame.

The slots 68, 70 also be sized and configured to retain the handle 62 in the extended position and/or in the retracted position. For instance, the slots 68, 70 may include one or more detents 72, which may engage the fasteners, pins or projections to help retain the handle 62 in the extended position and/or in the retracted position. The slots 68 may include an extended portion 74 that may be sized and configured to permit an intermediate structure 76 between the slots to deform and/or deflect to help the detents 72 engage the fasteners, pins or projections and retain the handle 62.

The handle 62 is preferably constructed from gas-assisted injection molding. Desirably, this may allow the grip 64 and the connecting members 66 to be integrally formed as part of a unitary, one-piece structure during the gas-assisted injection molding process. It will be appreciated, however, that grip 64 and the connecting members 66 may be constructed using other suitable molding or manufacturing processes and may be constructed from plastic, metal, wood and/or other materials having other suitable characteristics. It will be also appreciated that the grip 64 and the connecting members 66 may comprise discretely formed components, which may be constructed from different materials and/or different manufacturing processes from each other and then later assembled. It will be further appreciated that the handle 62 may include a variety of other components having other suitable sizes, shapes and/or configurations.

As mentioned above, the table 12 and the table top sections 18, 20 may be constructed from plastic, preferably using a blow-molding process. Advantageously, this may allow a lightweight table top 12 to be easily constructed and it may allow the table top to be formed into various desired configurations, shapes, sizes and designs. This may also allow a table top 12 to be constructed that is generally weather resistant and temperature insensitive, which may allow the table to be used in a wide variety of locations and environments. In addition, this may allow a table top 12 that is durable, long-lasting and corrosion resistant to be constructed. Further, because a table top 12 constructed from blow-molded plastic may be relatively strong, the table 10 may be used to support a relatively large amount of weight. Significantly, a table top 12 constructed from blow-molded plastic may also form a structural member of the table, but the table top may be supported by other structures, such as the frame 28.

Advantageously, a table top 12 constructed from blow-molded plastic may be relatively strong because it includes opposing walls or surfaces that are separated by a distance. The opposing walls may help create a high-strength, rigid table top. In addition, because the interior portion of the table top 12 may be generally hollow, that may create a lightweight table top. Thus, the blow-molded table top 12 may be both lightweight and strong. It will be appreciated, however, that the table top 12 need not be constructed using plastic or a blow-molding process and may be constructed from plastic, metal, wood and/or other materials using other processes.

The frame 28; the side rails 30, 32 and the side rail sections 34, 36, 38, 40 are preferably constructed from metal, such as metal tubes. Desirably, the metal tubes may be relatively strong, yet lightweight. It will be appreciated, however, that the frame 28; the side rails 30, 32 and the side rail sections 34, 36, 38, 40 do not require a tubular configuration and may be constructed from other suitable materials. It will also be appreciated that the table 10 does not require the frame 28; the side rails 30, 32 or the side rail sections 34, 36, 38, 40.

Figure 10:
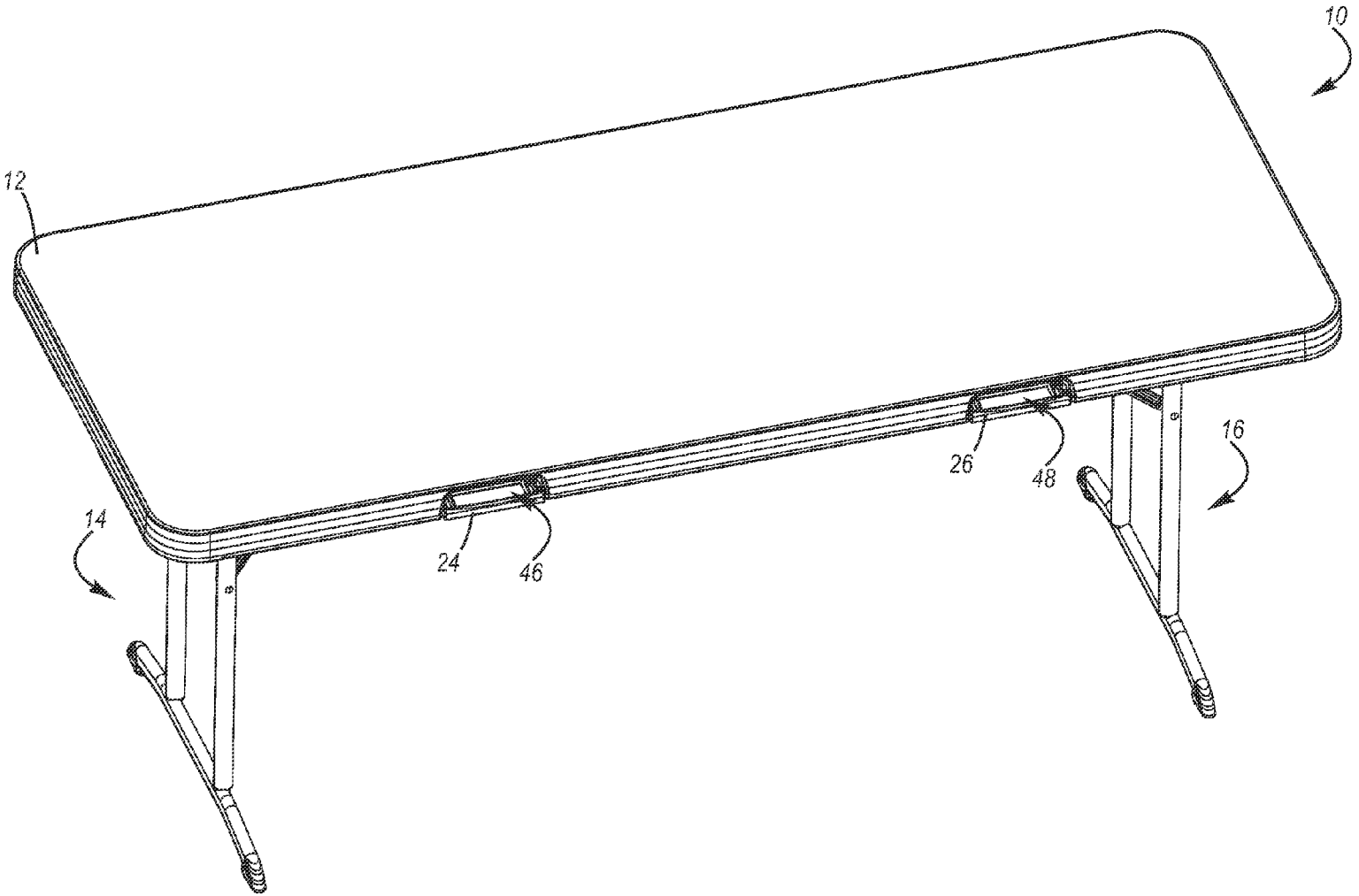
FIG. 10 is a perspective view of another exemplary table, illustrating the table with a unitary, one-piece table top.

As discussed above, the table top 12 may include movable table top sections 18, 20 and may be foldable. The table top 12, however, need not include movable sections and need not be foldable, as shown in FIG. 10. In fact, the table top 12 may have a unitary, one-piece construction formed, for example, during a blow-molding or other suitable manufacturing process. Likewise, the side rails 30, 32 need not include movable sections and need not be foldable and may have a unitary, one-piece construction, if desired.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A fold-in-half table comprising:

a table top constructed from molded plastic, the table top comprising a first section and a second section movable between a folded position and an unfolded position;

a first portion of a frame connected to the first section of the table top;

a second portion of a frame connected to the second section of the table top;

a first handle receiving portion integrally formed in a downwardly extending lip of the first section of the table top as part of a unitary, one-piece structure; and a second handle receiving portion integrally formed in a downwardly extending lip of the second section of the table top as part of a unitary, one-piece structure, the first and second handle receiving portions being disposed adjacent to each other when the table top is in the folded position, the first and second handle receiving portions being spaced apart when the table top is in the unfolded position;

a handle comprising:

a first portion of the handle directly connected to the first portion of the frame, the first portion of the handle at least partially disposed in the first receiving portion; and a second portion of the handle directly connected to the second portion of the frame, the second portion of the handle at least partially disposed in the second receiving portion, the first and second portions of the handle being disposed adjacent to each other when the table top is in the folded position to allow a user to simultaneously grasp the first and second portions of the handle with one hand to facilitate carrying the table, the first and second portions of the handle being spaced apart when the table top is in the unfolded position; and at least one support connected to the table top.

2. The fold-in-half table as in claim 1, wherein the first and second portions of the handle are movable between an extended position in which a portion of the first and second portions of the handle extend beyond an outer edge of the table top and a retracted position in which the first and second portions of the handle do not extend beyond the outer edge of the table top.

3. The fold-in-half table as in claim 1, wherein the first portion of the frame is disposed generally parallel to an inner wall of the generally downwardly extending lip of the first section of the table top;

wherein the first portion of the frame is disposed inwardly from the first handle receiving portion;

wherein the second portion of the frame is disposed generally parallel to an inner wall of the generally downwardly extending lip of the second section of the table top; and wherein the second portion of the frame is disposed inwardly from the second handle receiving portion.

4. A fold-in-half table movable between a folded position and an unfolded position, the fold-in-half table comprising:

a table top comprising:

a first table top section constructed from plastic;

a first lip extending downwardly from the first table top section;

a first handle receiving portion integrally formed in the first lip of the first table top section during a molding process as part of a unitary, one-piece construction;

a second table top section constructed from plastic;

a second lip extending downwardly from the second table top section; and a second handle receiving portion integrally formed in the second lip of the second table top section during a molding process as part of a unitary, one-piece construction, the first and second handle receiving portions disposed generally adjacent to each other when the table top is in the folded position, the first and second handle receiving portions being spaced apart when the table top is in the unfolded position;

a frame comprising a first portion connected to the first section of the table top and a second portion connected to the second section of the table top; and a handle comprising:

a first portion of the handle connected to the first portion of the frame;

a gripping portion of the first portion of the handle sized and configured to be grasp by a user, the gripping portion sized and configured to be at least substantially disposed in the first handle receiving portion;

a second portion of the handle connected to the second portion of the frame, the first and second portions of the handle being disposed at least adjacent to each other when the table top is in the folded position, the first and second portions of the handle being spaced apart from each other when the table top is in the unfolded position; and a gripping portion of the second portion of the handle sized and configured to be grasp by a user, the gripping portion sized and configured to be at least substantially disposed in the second handle receiving portion; and at least one support member connected to the table top.

5. The fold-in-half table as in claim 4, wherein when the table top is in the folded position, the first portion of the handle and the second portion of the handle are sized and configured to be collectively and simultaneously grasped by a single hand of a user to carry the table and help prevent the table top from unintentionally unfolding.

6. The table as in claim 4, wherein the first and second portions of the handle are movable between an extended position in which a portion of the first and second portions of the handle extend beyond an outer edge of the table top and a retracted position in which the first and second portions of the handle do not extend beyond the outer edge of the table top.

7. The table as in claim 4, wherein the first portion of the frame is spaced inwardly from the first lip of the first section of the table top;

wherein the first portion of the frame is spaced inwardly from the first handle receiving portion;

wherein the second portion of the frame is spaced inwardly from the second lip of the second section of the table top; and wherein the second portion of the frame is spaced inwardly from the second handle receiving portion.

8. The table as in claim 4, further comprising:

a first fastener extending through a first wall of the first portion of the frame and a second wall of the first portion of the frame and connecting a first connecting portion of the first portion of the handle to the first portion of the frame; and a second fastener extending through the first wall of the first portion of the frame and the second wall of the first portion of the frame and connecting a second connecting portion of the first portion of the handle to the first portion of the frame.

9. The table as in claim 4, further comprising:

a first fastener extending through a first wall of the first portion of the frame and a second wall of the first portion of the frame and connecting a first connecting portion of the first portion of the handle to the first portion of the frame;

a second fastener extending through the first wall of the first portion of the frame and the second wall of the first portion of the frame and connecting a second connecting portion of the first portion of the handle to the first portion of the frame;

a third fastener extending through a first wall of the second portion of the frame and a second wall of the second portion of the frame and connecting a first connecting portion of the second portion of the handle to the second portion of the frame; and a fourth fastener extending through the first wall of the second portion of the frame and the second wall of the second portion of the frame and connecting a second connecting portion of the second portion of the handle to the second portion of the frame.

10. The table as in claim 4, further comprising a generally planar engagement surface of the first portion of the handle and a generally planar engagement surface of the second portion of the handle, the generally engagement surfaces of the first and second portions of the handle being sized and configured to abut when the table top is in the folded position.

11. The table as in claim 4, wherein the first handle receiving portion includes an upper surface that is generally aligned with a lower surface of the first section of the table top; and wherein the second handle receiving portion includes an upper surface that is generally aligned with a lower surface of the second section of the table top.

12. The table as in claim 4, wherein the handle is capable of being disposed in an extended position in which the gripping portion of the first portion of the handle and the gripping portion of the second portion of the handle are disposed outside of the first and second handle receiving portions; and wherein the handle is capable of being disposed in a retracted position in which the gripping portion of the first portion of the handle and the gripping portion of the second portion of the handle are disposed within the first and second handle receiving portions.

13. The table as in claim 4, further comprising:

a first fastener extending through an inner wall and an outer wall of the first portion of the frame, the first fastener connecting a first end of the handle to the first portion of the frame; and a second fastener extending through the inner wall and the outer wall of the first portion of the frame, the second fastener connecting a second end of the handle to the first portion of the frame.

14. A fold-in-half table comprising:

a molded plastic table top including a first section and a second section movable between a folded position and unfolded position;

a first portion of a frame connected to the first section of the table top;

a second portion of the frame connected to the second section of the table top;

a first handle receiving portion integrally formed in a downwardly extending lip of the first section of the table top as part of a unitary, one-piece structure;

a second handle receiving portion integrally formed in a downwardly extending lip of the second section of the table top as part of a unitary, one-piece structure;

a hinge assembly connecting the first portion of the frame and the second portion of the frame;

a first portion of a handle connected to the first portion of the frame and at least partially disposed in the first handle receiving portion; and a second portion of the handle connected to the second portion of the frame and at least partially disposed in the second handle receiving portions wherein the first portion of the handle is disposed at least adjacent to the second portion of the handle when the frame is in the folded position, the first portion of the handle and the second portion of the handle being spaced apart when the table frame is in the unfolded position;

wherein the first portion of the handle comprises at least a portion of a grip and the second portion of the handle comprises at least a portion of a grip; and wherein the grip of the first portion of the handle and the grip of the second portion of the handle are sized and configured to be simultaneously grasped by a single hand of a user when the frame is in the folded position.

15. The fold-in-half table as in claim 14, wherein the first potion of the frame includes an outer wall and an inner wall that are spaced apart by a hollow interior portion; and wherein the second portion of the frame includes an outer wall and an inner wall that are spaced apart by a hollow interior portion.

16. The fold-in-half table as in claim 15, wherein the inner wall of the first portion of the frame has a generally planar outer surface and the outer wall of the first portion of the frame has a generally planar outer surface, the inner wall of the first portion of the frame disposed generally parallel to the outer wall of the first portion of the frame; and wherein the inner wall of the second portion of the frame has a generally planar outer surface and the outer wall of the second portion of the frame has a generally planar outer surface, the inner wall of the second portion of the frame disposed generally parallel to the outer wall of the second portion of the frame.

17. The fold-in-half table as in claim 15, wherein the first portion of the handle further comprises:

a grip;

a first fastener extending through the inner wall and the outer wall of the first portion of the frame, the first fastener connecting a first end of the first portion of the handle to the first portion of the frame; and a second fastener extending through the inner wall and the outer wall of the first portion of the frame, the second fastener connecting a second end of the first portion of the handle to the first portion of the frame; and wherein the second portion of the handle further comprises:

a grip;

a first fastener extending through the inner wall and the outer wall of the second portion of the frame, the first fastener connecting a first end of the second portion of the handle to the second portion of the frame; and a second fastener extending through the inner wall and the outer wall of the second portion of the frame, the second fastener connecting a second end of the second portion of the handle to the second portion of the frame.

18. The fold-in-half table as in claim 14, further comprising:

a first support structure connected to the first portion of the frame, the first support structure movable between an extended position and a collapsed position; and a second support structure connected to the second portion of the frame, the second support structure movable between an extended position and a collapsed position.

19. The fold-in-half table as in claim 14, wherein a contact surface of a first end of the first portion of the handle contacts the outer wall of the first portion of the frame;

wherein a contact surface of a second end of the first portion of the handle contacts the outer wall of the first portion of the frame;

wherein a contact surface of a first end of the second portion of the handle contacts the outer wall of the second portion of the frame; and wherein a contact surface of a second end of the second portion of the handle contacts the outer wall of the second portion of the frame.

* * * * *

UNITED STATES PATENT AND TRADEMARK OFFICE

CERTIFICATE OF CORRECTION

PATENT NO. : 8,544,393 B2
APPLICATION NO. : 13/458836
DATED : October 1, 2013
INVENTOR(S) : Branch et al.

It is certified that error appears in the above-identified patent and that said Letters Patent is hereby corrected as shown below:

On the Title Page, in Item (57), under "ABSTRACT", in Column 2, Line 11, delete "refracted" and insert -- retracted --, therefor.

In the Specifications:

In Column 3, Line 39, delete "refracted" and insert -- retracted --, therefor.

In Column 3, Line 53, delete "refracted" and insert -- retracted --, therefor.

In Column 4, Line 10, delete "refracted" and insert -- retracted --, therefor.

In Column 9, Line 5, delete "refracted" and insert -- retracted --, therefor.

In Column 9, Line 58, delete "table 12" and insert -- table 10 --, therefor.

In the Claims:

In Column 12, Line 16, in Claim 6, delete "The table" and insert -- The fold-in-half table --, therefor.

In Column 12, Line 22, in Claim 7, delete "The table" and insert -- The fold-in-half table --, therefor.

In Column 12, Line 32, in Claim 8, delete "The table" and insert -- The fold-in-half table --, therefor.

In Column 12, Line 43, in Claim 9, delete "The table" and insert -- The fold-in-half table --, therefor.

In Column 12, Line 64, in Claim 10, delete "The table" and insert -- The fold-in-half table --, therefor.

Signed and Sealed this
Seventh Day of January, 2014

Margaret A. Focarino

Margaret A. Focarino
*Commissioner for Patents of the United States Patent and Trademark Office*

In Column 13, Line 3, in Claim 11, delete “The table” and insert -- The fold-in-half table --, therefor.

In Column 13, Line 9, in Claim 12, delete “The table” and insert -- The fold-in-half table --, therefor.

In Column 13, Line 19, in Claim 13, delete “The table” and insert -- The fold-in-half table --, therefor.

In Column 13, Line 49, in Claim 14, delete “portions” and insert -- portion; --, therefor.

In Column 14, Line 2, in Claim 15, delete “potion” and insert -- portion --, therefor.